US005964061A

United States Patent [19]

Hughes et al.

[11] Patent Number: 5,964,061

[45] **Date of Patent: *Oct. 12, 1999**

[54] SLIDING DOOR CORNER CONNECTOR

[75] Inventors: Stephen J. Hughes, Scarborough; Bernard H. Robbins, Parry Sound, both of Canada

[73] Assignee: The Stanley Works, New Britain, Conn.

[ * ] Notice: This patent is subject to a terminal disclaimer.

[21] Appl. No.: 08/943,486

[22] Filed: Oct. 3, 1997

Related U.S. Application Data

[63] Continuation-in-part of application No. 08/583,281, Jan. 5, 1996, Pat. No. 5,673,516.

[51] Int. Cl.[6] ..... E05D 15/36

[52] U.S. Cl. ..... 49/425; 49/403; 49/410

[58] Field of Search ..... 49/403, 425, 410, 49/411; 16/105, 32

[56] References Cited

U.S. PATENT DOCUMENTS

| | | |
|---|---|---|
| 3,011,209 | 12/1961 | Majeske . |
| 3,298,136 | 1/1967 | Saunders . |
| 3,460,290 | 8/1969 | Wutzke . |
| 4,262,451 | 4/1981 | Dallaire . |
| 4,391,019 | 7/1983 | Downes . |
| 4,633,615 | 1/1987 | Moose . |
| 4,850,145 | 7/1989 | McAfee . |
| 4,884,371 | 12/1989 | Gagnon . |
| 5,349,783 | 9/1994 | Jasperson et al. . |

FOREIGN PATENT DOCUMENTS

| | | |
|---|---|---|
| WO 95/02105 | 1/1995 | WIPO . |

*Primary Examiner*—Daniel P. Stodola
*Assistant Examiner*—Curtis Cohen

[57] ABSTRACT

A corner connector for a door having frames and stiles seating a panel therewithin includes a bracket providing a channel in which is a generally planar body portion and a door mounting member so as to slidably movable on the bracket in a direction generally parallel to the sidewalls of the bracket. The door mounting member has a body portion, an engaging portion extending outwardly of the channel for engagement with a door supporting surface, and a threaded fastener seated in the body portion which has a head bearing on an end wall of the bracket which has an aperture smaller than the head of the fastener. This provides access for a tool to engage the head of the fastener to adjust the spacing between the mounting member and the bracket end wall and thereby the distance which the engaging portion extends from the bracket. The fastener also transfers loads from the door mounting member to the bracket end wall.

13 Claims, 16 Drawing Sheets

SLIDING DOOR CORNER CONNECTOR

CROSS REFERENCE TO RELATED APPLICATION

The present application is a continuation-in-part of our application Ser. No. 08/583,281 filed Jan. 5, 1996, now U.S. Pat. No. 5,673,516.

BACKGROUND OF THE INVENTION

The present invention relates to corner connectors for panel door, having stiles and rails seating a frame and, more particularly, to such connectors including a bracket to couple the door frame members and a mounting member for mounting the door in the door opening.

Corner connectors for sliding doors which include bottom rollers or other track guiding devices which permit the door to slide along a track disposed on the floor are known. Exemplary of such connectors is that described and illustrated in U. S. Pat. No. 4,391,019 issued to Downes on Jul. 5, 1983. This connector employs a vertically disposed arm which is slidably connected to a bracket by a longitudinal slot which seats a T-shaped projection on the connector bracket. The slot in the arm includes a portion of increased width to permit the head of the T-shaped projection to be inserted into the slot and thereafter be captured by the narrower portion of the remainder of the slot. In this way, the stem of the T-shaped projection moves within the slot. One problem with this arrangement is that the stem of the T-shaped projection offers a limited surface against which the arm bears during relative movement. Since the arm also carries the track guide member, e.g., a roller or the like, it is subject to loads which act on the door, particularly when the arm carries a roller which supports the bottom of the door. Hence, the bracket to arm connection experiences loads in different directions which are not readily transferred to contiguous bearing surfaces. The arm is substantially unsupported along its sides and along the interconnecting surfaces which cause the forces to be distributed unevenly and become concentrated. Such force concentration can lead to material wear and fatigue, particularly in the T-shaped arm and slot connection disclosed in U.S. Pat. No. 4,391,019.

The sliding door bracket also provides the support for the door in the track system in which it moves so that it slides freely without excessive play. Thus, it is important that the connector be rigid and securely connect the components of the sliding door to one another. Other connectors may use guides or slides slidable in the channel of a track, alone and in combination with rollers, and still others may use pivot members.

The connection between the stile and the bottom rail is at a right angle and the door panel is to be held tightly therebetween. In the past, one way to assure such a rigid connection was to rivet the connector to the framing members. However, it has now been found that it is more desirable and cost effective to permit the consumer to assemble the door on site. Thus, any such connector must be easily assembled with the component parts.

Accordingly, it is an object of the present invention to provide a novel connector for panel doors which includes a bracket which may be fabricated relatively inexpensively and which is readily connectable to the panel door frame components by a consumer without complex tools and/or a high degree of skill and a support member which is insertable into the bracket after assembly with the frame components.

It is also an object to provide such a connector which is relatively long-lived and in which different mounting members may be employed.

Another object is to provide such a connector in which the length of the projecting portion of the mounting member may be adjusted.

SUMMARY OF THE INVENTION

It has now been found that the foregoing and related objects may be readily attained in a corner connector for a door having frames and stiles seating a panel therewithin comprising a bracket having a generally planar body portion, and sidewalls extending perpendicularly to the body portion along opposite sides thereof. The sidewalls have inwardly extending lips along at least a portion of their length, and the lips extending parallel to and over the body portion to define a channel therebetween. The bracket also has an end wall extending perpendicularly to the body portion at one end thereof and between the sidewalls, and an end flange at the other end of the body portion extending perpendicularly to the body portion in a direction oppositely of the sidewalls and end wall. The sidewalls and end flange have means thereon for engagement with the stiles and rails to secure them in assembly.

The corner connector also has a door mounting member slidably seated within the channel of the bracket, and it has a first surface slidably movable on the body portion of the bracket in a direction generally parallel to the sidewalls. The door mounting member also has a body portion and an engaging portion extending outwardly of the channel for engagement with a door supporting surface. A threaded fastener is seated in the body portion and has a head bearing on the bracket end wall, which has an aperture smaller than the head of the fastener. This provides access for a tool to engage the head of the fastener to adjust the spacing between the mounting member body portion and the bracket end wall and thereby the distance which the engaging portion extends from the bracket. The fastener also transfers loads from the door mounting member to the bracket end wall.

The body portion of the bracket and the mounting member having cooperating deflectable detent and channel means thereon to permit sliding insertion of the mounting member into the channel of the bracket by deflection of the detent until seated in the channel means and thereafter to limit movement of the mounting member outwardly of the channel.

In one embodiment, the engaging portion is a roller rotatably mounted on the mounting member for rolling movement along a track providing a support surface about the door opening. In another embodiment, the engaging portion is a slide guide for sliding movement along a track providing the surface about the door opening. In still another embodiment, the engaging portion is a pivot element for engagement with the header or floor surface about the door opening.

Preferably, the mounting member has a body element, an engaging element and means securing the body and engaging elements in assembly. The detent means is a resiliently deflectable element formed in the body portion of the bracket and the channel means is a slot in the body portion of the mounting member. The bracket may be metallic and the mounting member may be fabricated of synthetic resin.

DETAILED DESCRIPTION OF THE PREFERRED EMBODIMENT

Turning first to FIGS. 1–4 of the attached drawings, therein illustrated is a connector for sliding doors embodying the present invention and generally designated by the numeral 1. The sliding door is comprised of a panel 2 such as a mirror or laminated hardboard and a frame provided by the stiles 6 at its side edges and the rails 8 along its top and bottom edges.

Figure 1:
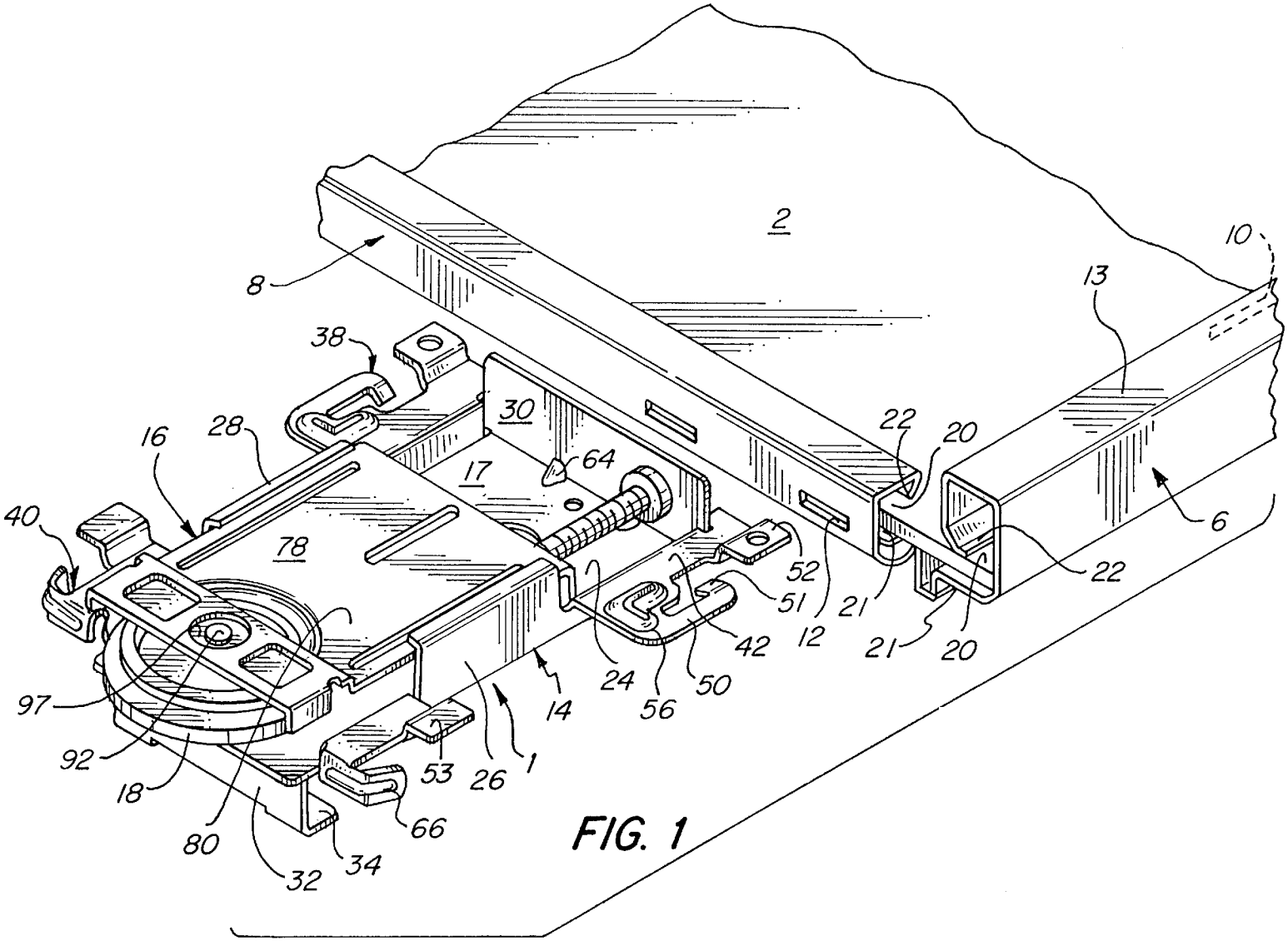
FIG. 1 is a fragmentary perspective view of a door panel with its frame members and of a sliding door connector embodying the present invention removed therefrom.
Figure 3:
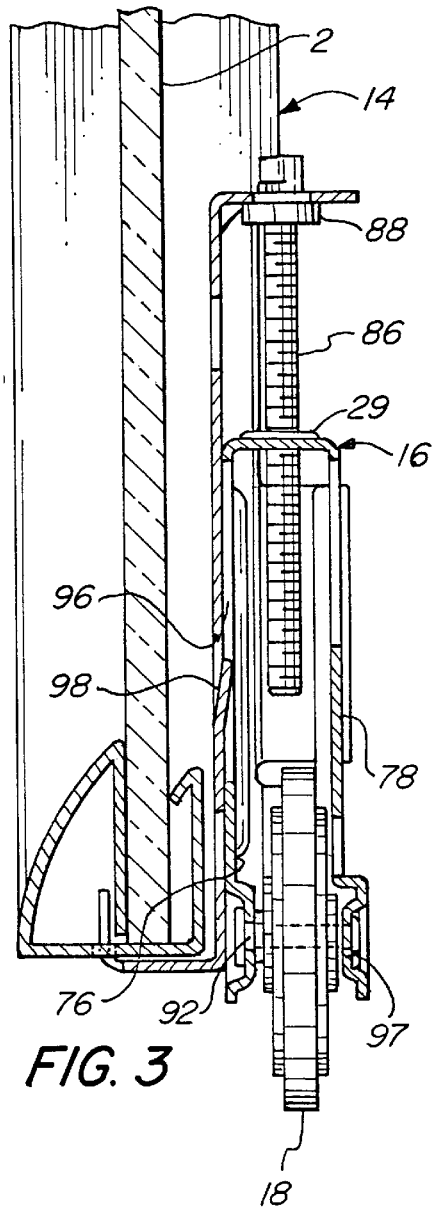
FIG. 3 is a sectional view along the line 3—3 in FIG. 2.

As illustrated in FIGS. 1 and 3, the cross sectional configuration of the stiles 6 and the rails 8 provides channels 20 which receive the edges of the panel 2. The channel 20 is defined by an elongated depending wall 21 and a short, deflectable depending lip 22 to seat the panel 2 snugly therebetween. Each rail 8 has a pair of longitudinally spaced and extending slots 12 adjacent each end thereof. Adjacent the end of each stile 6 is provided a longitudinally extending slot 10 so that when the ends of the stiles 6 and rails 8 are brought together at right angles the slots 10, 12 will receive portions of the connector 1 to effect a connection therebetween.

Figures 5, 6, 7:
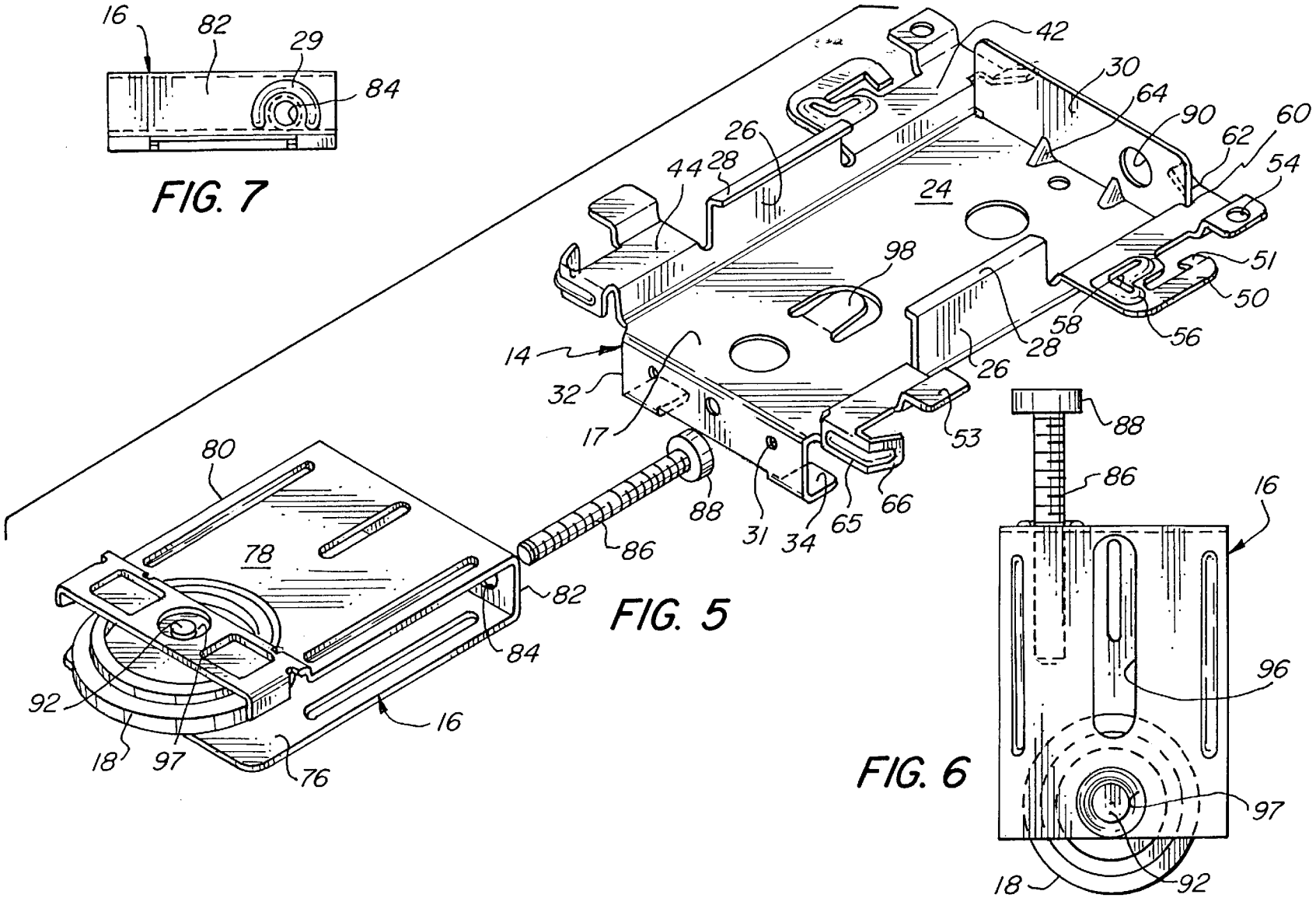
FIG. 5 is a partially exploded perspective view of he connector.
FIG. 6 is a side elevational view of the roller mounting member shown apart from the mounting bracket.
FIG. 7 is a top view of the roller mounting member.

As seen in FIGS. 1 and 5, the connector 1 is elongated and is comprised of a bracket generally designated by the numeral 14 and roller mounting member generally designated by the numeral 16 which is slidably seated within the bracket 14 and which has a track engaging roller 18 at its lower end to support the weight of the door as it moves along a floor track (not shown). The bracket 14 has a generally planar body portion 24 having an inner surface 17 upon which the mounting member 16 is slidable. Along the sides thereof are side walls 26 each having outwardly extending flanges 38 and 40 at the ends thereof and an inwardly extending lip 28 centrally thereof. The side walls 26 and the body portion 24 define a channel in which the roller mounting member 16 is seated, and the lip 28 retains the roller mounting member 16 therein.

As seen in FIG. 5, an end wall 30 extends perpendicularly to the upper end of the body portion 24 transversely across the width thereof between the side walls 26 to close the channel at its upper end. A flange 32 extends perpendicularly to the other or lower end of the bracket body portion 24 at its other end and in a direction opposite to the sidewalls 26 and end walls 30. Along the free end of the flange 32 is a pair of holding tabs 34 which extend parallel to the plane of the body portion 24 and seat in the slots 12 in the bottom wall of the rail 8. While illustrated as part of the bracket 14, it should be understood that the holding tabs 34 on the flange 32 may be omitted, or removed or flattened, and the flange 32 may be connected to the rail 8 by screws passing through openings 31 in the flange 32 when the rail 8 is not adapted to receive the tabs 34, such as when the frame is formed from a hardwood greater than the thickness for which its channel was intended.

Figure 2:
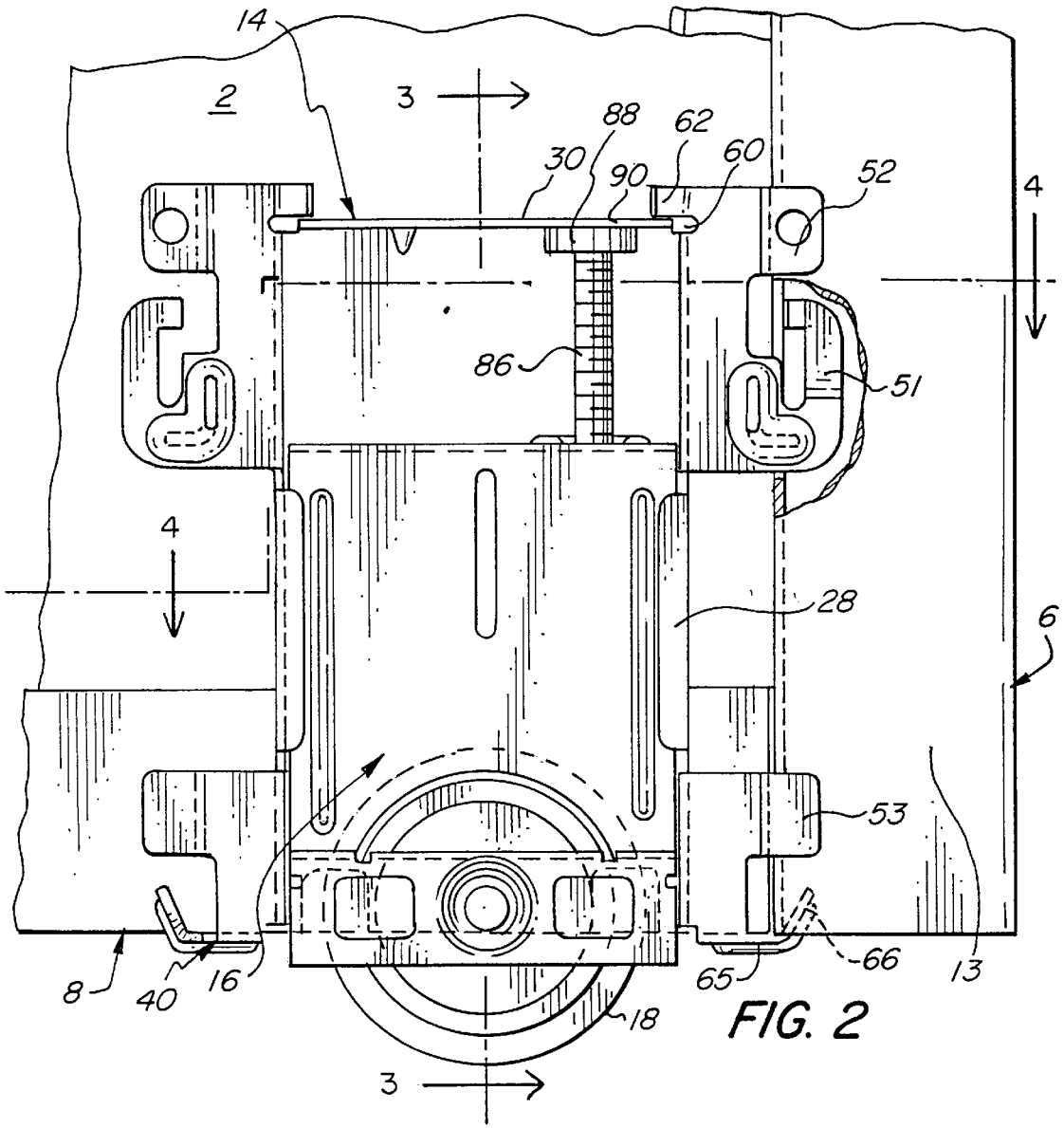
FIG. 2 is a fragmentary side elevational view of the assembled bottom right corner of the door.
Figure 4:
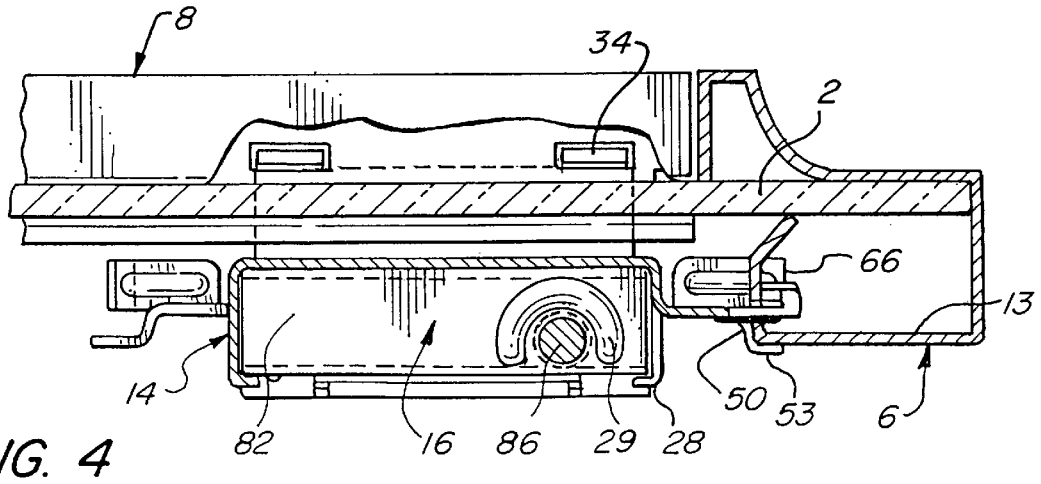
FIG. 4 is a sectional view along the line 4—4 in FIG. 2.

As seen in FIGS. 1–4, the upper side flanges 38 on the bracket 14 and the lower side flanges 40 have generally planar body portions 42 and 44 extending generally parallel to the plane of the body portion 24. As seen in FIG. 1, the planar body portion 42 of the flange 38 is formed with a generally G-shaped tab 50 which has a free end providing an inturned snap tip 51. tabs 50 are generally coplanar with the planar portion 42 except for the snap tip 51 which is angled towards the plane of the body portion 24. This allows the tip 51 to pass into the slot 10 formed in the side of the stile 6 and thereafter snap in place behind the interior surface of its side wall 13 as best illustrated in FIG. 2. An upwardly offset tab 52 on the flange 38 extends in a plane generally parallel to the plane of the bracket body portion 24 and is spaced above the plane of the planar portion 42. This cooperates with the G-shaped tab 50 and bears against the outer surface of the stile 6 to capture it therebetween.

Each G-shaped tab 50 is provided with weakening section 56 which permits the tab 50 to be broken off in the event that the stile 6 is cut adjacent its end so that the slot 10 is no longer present or aligned therewith. In this circumstance, the offset tab 52 is connected to the stile 6 by a screw (not shown) which extends through an aperture 54 in the tab 52. The weakening section 56 has an L-shaped slot 58 and a deformed region surrounding the slot 58 which allows the tab 50 to be broken off when a tool, such as a screwdriver tip, is inserted therein and moved back to flex the tab 50 until it breaks off.

Each flange 42 also includes a notch 60 which receives the upper end wall 30 therewithin. Thus, the flange 42 has a portion 62 which extends behind the end wall 30 so as to abut the outer face of the end wall 30 and provide it with enhanced load bearing capacity. This is important because the weight of the door bears on the end wall 30 by forces imparted to it through the mounting member 16. The juncture of the body portion 24 and end wall 30 may be further stiffened by providing spot welds or staking gussets 64 therealong.

As seen in FIG. 2, the lower end flange 40 secures the lower end of the bracket 14 to the open end of the stile 6. The lower end flange 40 includes at its lower end an arm portion 65 which extends outwardly of and perpendicularly to the planar body portion 40 and provides a tab 66 which extends upwardly so as to engage the inner surface of the stile 6 as best seen in FIG. 2. At its upper end, the flange 40 has an upwardly offset, outwardly extending tab 53 which extends parallel to the body portion 24 along the outer surface of the stile 6. The tab 66 works in conjunction with the offset tab 53 to seat the wall of the stile 6 therebetween.

As seen in FIG. 5, the roller mounting member 16 is cooperatively dimensioned to slidingly seat in the channel of the bracket 14 and has a generally rectangular configuration with its upper end portion seated within the channel of the bracket 14 and its lower end portion extending below the bracket 14. In this embodiment, the roller mounting member 16 has a generally U-shaped body 80 with spaced sidewalls 76 and 78 which extend generally parallel to the plane of the body portion 24 of the bracket 14 and an end wall 82 at its upper end.

Figure 8:
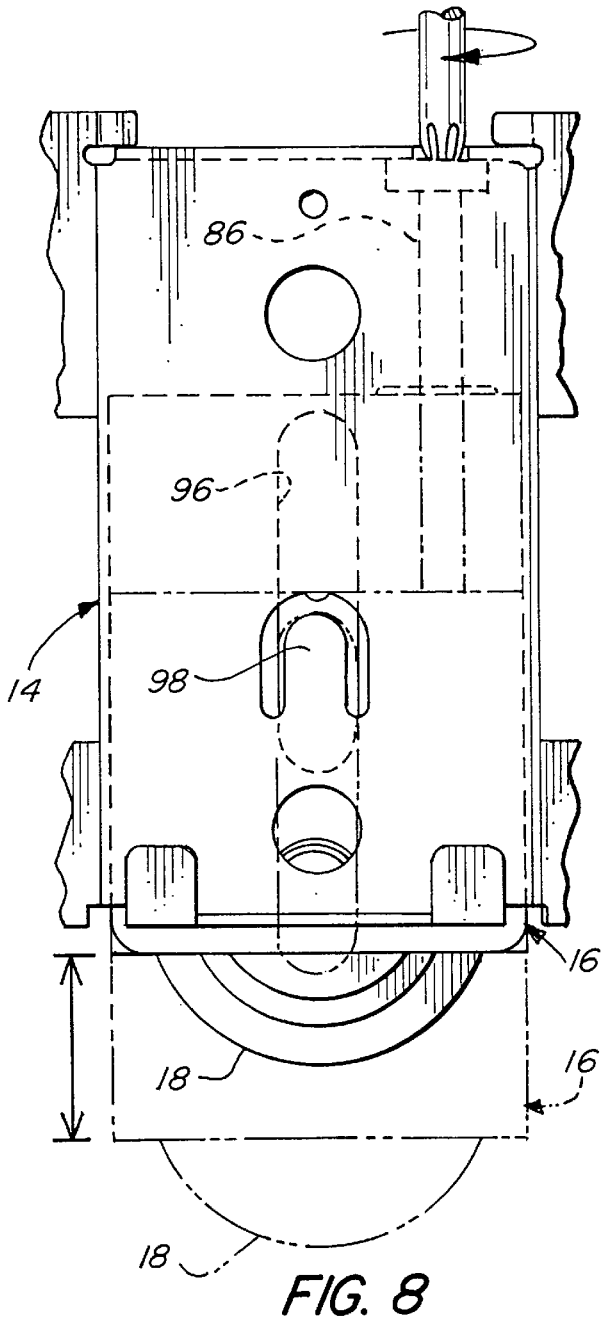
FIG. 8 is a partially fragmentary elevational view of the connector and panel assembly showing in phantom line an adjusted portion of the roller mounting member and also showing a screwdriver blade to effect the adjustment.

As seen in FIGS. 7 and 8, the end wall 82 of the roller mounting member 16 is provided with an aperture 84 which threadably seats a machine screw 86 having a head 88 which abuts against the lower surface of the end wall 30 of the bracket 14 to transfer the door load to it. The end wall 82 is provided with a stiffening rib 29 about the aperture 84. The screw 86 enables adjustment of the position of the roller mounting member 16 and thereby the door height above the supporting surface and reduces play in the door by allowing the door to be moved upwardly snugly against the upper track (not shown). The end wall 30 has an access aperture 90 therein which permits a screwdriver blade to be inserted through the end wall 30 of the bracket 14 to engage the head 88 of the screw 86 in order to make such adjustments.

The roller 18 is rotatably mounted adjacent the lower end of the mounting member 16 on a shaft 92 which extends through aligned apertures in the sidewalls 76 and 78. As seen in FIG. 3, about each of the apertures 93 in the sidewalls 76 and 78 of the mounting member 16 is an annular inwardly deformed portion 97 which centers the hub of the roller 18 within the mounting member 16 and spaces the circumferential portion of the roller 18 from the sidewalls 76, 78.

The roller mounting member 16 as shown in FIGS. 3 and 8 is limited in its movement outwardly of the bracket 14 by a detent or tab 98 which extends inwardly from the body portion 24 and seats in the elongated slot 96 in the sidewall 76 of the mounting roller member 16. The detent 98 is resiliently deflectable to be deflected into the plane of the bracket body portion 24 when the upper end of the roller mounting member 16 is inserted into the bracket 14 until it springs into the slot 96 upon continued movement of the mounting member 16 toward the upper end flange 30 of the bracket 14.

Figure 9:
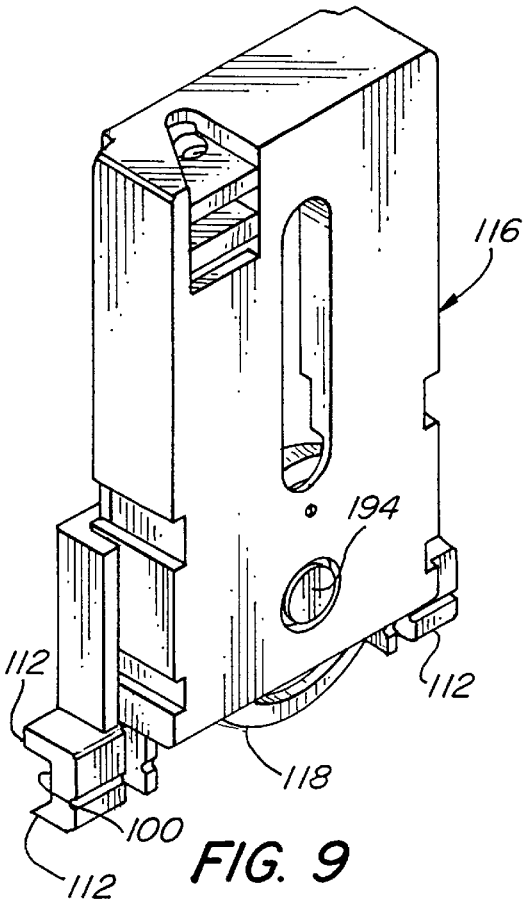
FIG. 9 is a perspective view of another embodiment of the roller mounting member.
Figure 10:
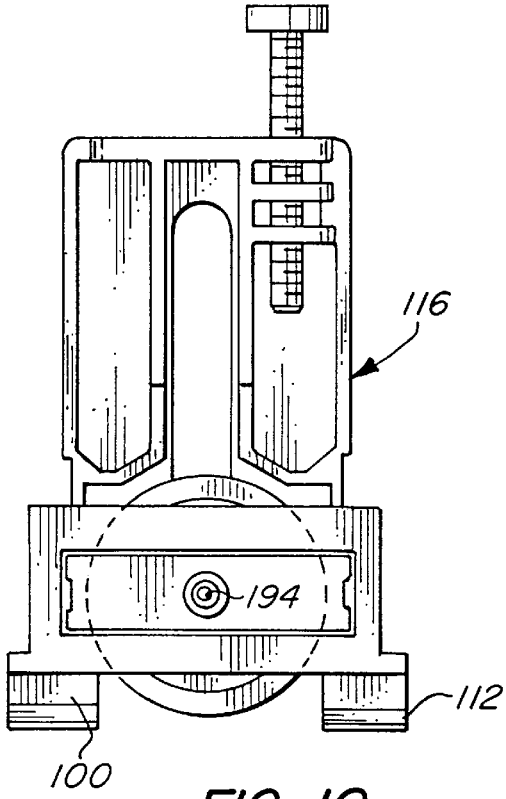
FIG. 10 is a side elevational view of the mounting member of FIG. 9.

In FIGS. 9 and 10, there is illustrated another embodiment of roller mounting member 116. This member 116 is a molded synthetic resin block which similarly rotatably mounts a roller 118 about a transversely extending shaft 194 journaled in the sidewalls of the block. The block may be formed from various materials, including glass impregnated nylon, acetal or other durable resins. At the lower end of the member 116 is a deflectable depending track follower element 100 having horizontal portions 112 which engage the track (not shown) to prevent derailing of the roller 118.

Figure 12:
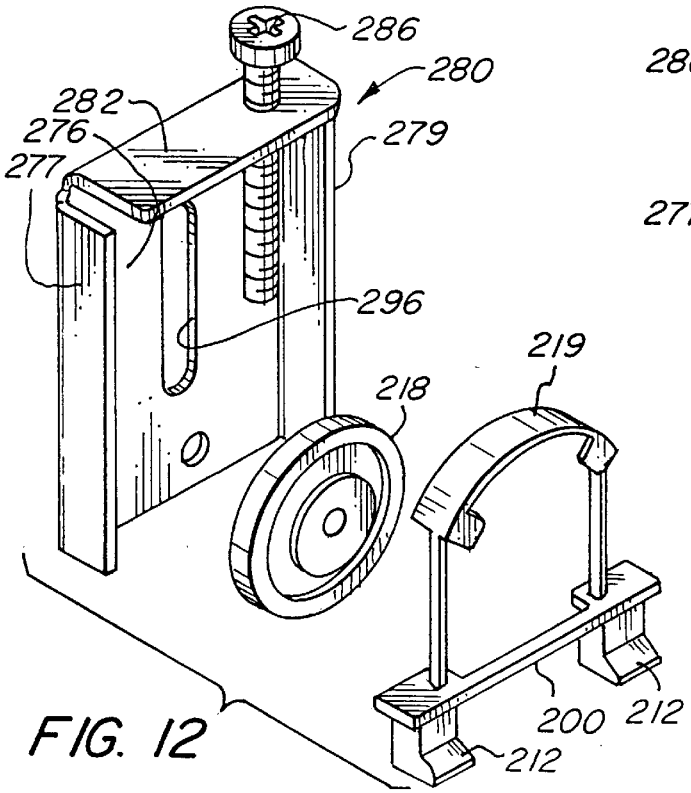
FIG. 12 is a partially exploded view of the roller mounting member of FIG. 11.
Figure 11:
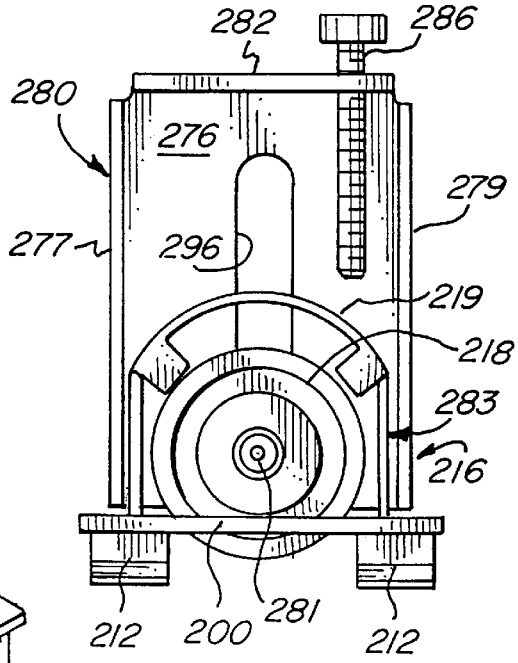
FIG. 11 is a front elevational view of still another embodiment of roller mounting member.

In FIGS. 11 and 12 there is illustrated a further embodiment of roller mounting member generally designated by the numeral 216 which utilizes a body 280 formed of sheet metal with a base wall 276, side walls 277, 279 and an end wall 282 at its upper end which seats the screw 286. The base wall 280 has an elongated slot 296 which cooperates with the detent 98 in the bracket 14. The roller 218 is rotatably mounted on the base wall 276 by a rivet 281, and an antijump member 283 is disposed thereabout. The antijump member 283 is integrally molded and seats in the body 280. Extending above the roller 218 is an arch portion 219, and the bottom portion 200 slides on the door track (not shown) with the portions 212 engaging in the track to prevent jumping.

In assembling the connector to the panel 2 and frame elements 6, 8, the roller mounting member 16 with the roller 18 mounted therein may be initially inserted into the channel of the bracket 14 until the detent 98 snaps into the slot 96 of the mounting member 16. Thereafter, depending on whether the connector is to be used in a right or left corner of the panel, the side flanges 38 and 40 disposed along the corresponding right or left lateral side of the bracket 14 are used in the connection. In the illustrated example of FIG. 1, the right corner of the door is being connected and those along the right side of the bracket 14 are used. The tab 66 is first engaged in the open end of the stile 6 and the tabs 34 of the lower end flange 32 are inserted into the slots 12. Thereafter, the bracket 14 is pivoted toward the slot 10 in the stile 6 until the G-shaped tab 50 is inserted through the slot 10 and the tip 51 snaps against the inner surface of the stile 6. Concurrently, the tabs 52, 53 seat against the outer surface of the stile 6 and the body portion 24 seats against the outer surface of the rail 8 to engage the stile 6 and rail 8 firmly with the bracket 14.

The stiles and rails are conventionally fabricated from steel or aluminum to provide a rigid frame while providing some degree of flexure to grip the panel securely. The bracket is conveniently stamped from sheet metal of about 0.030–0.050 inch thickness. The roller mounting member may be similarly stamped from sheet metal as in the embodiment of FIGS. 1–8 or molded from synthetic resin as in the embodiment of FIGS. 9 and 10. The rollers are conveniently molded from synthetic resin such as nylon, polypropylene and acetal.

Figure 13:
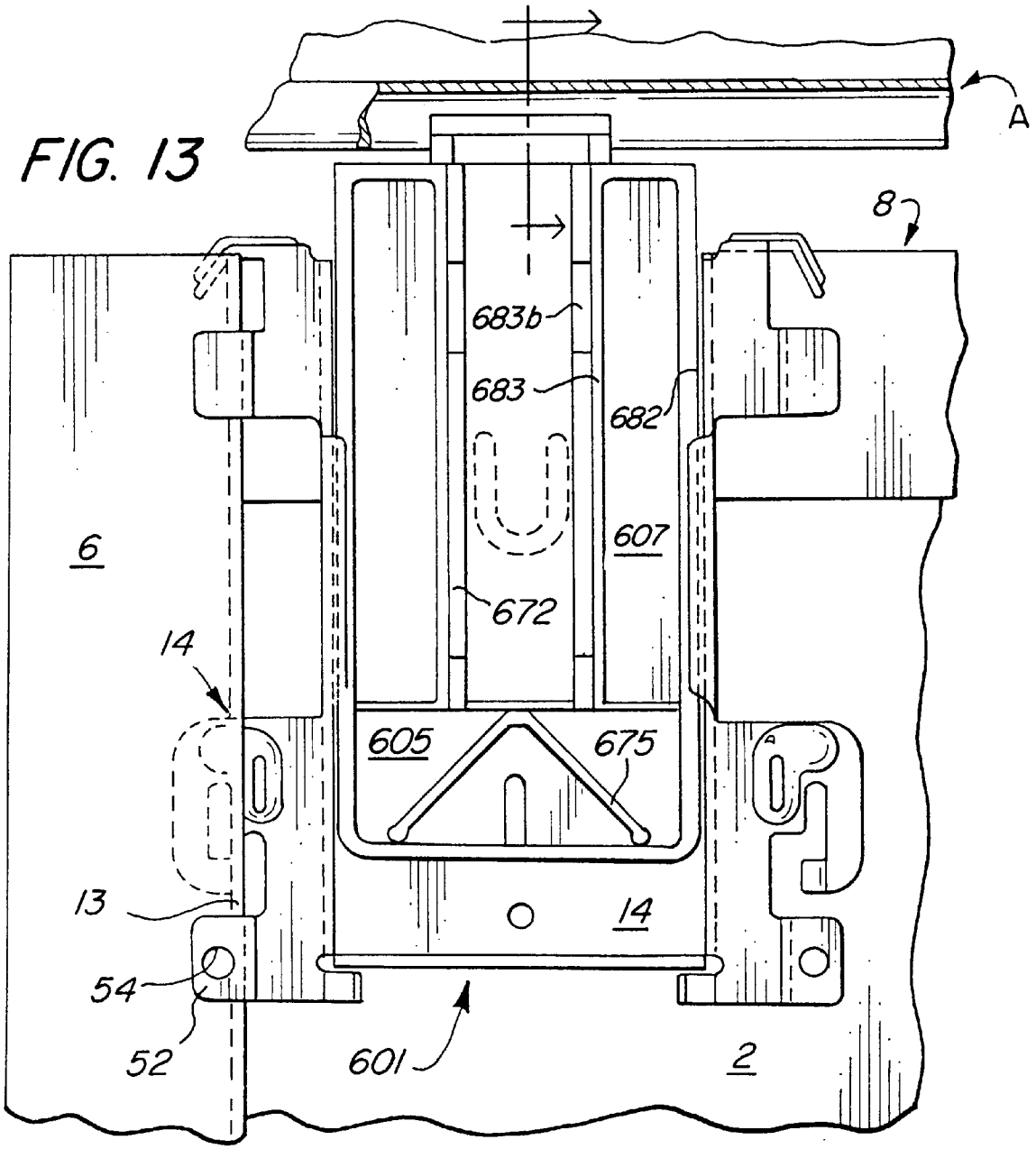
FIG. 13 is a front elevational view of another embodiment of a corner connector embodying the present invention and having a door guide which slides in a track.

Turning next to FIG. 13 of the attached drawings, therein illustrated is a corner connector embodying the present invention and generally designated by the numeral 601 and providing a sliding door guide for sliding doors. The connector 101 comprises the bracket 14, an outer guide member 605 slidably seated in the bracket 14 and an inner guide member 607 slidably seated in the outer guide member 605.

The bracket 14 is substantially as illustrated in FIG. 5 and the same reference numerals are applied thereto. The bracket 14 is similarly engaged with the stiles and rails.

Figure 14:
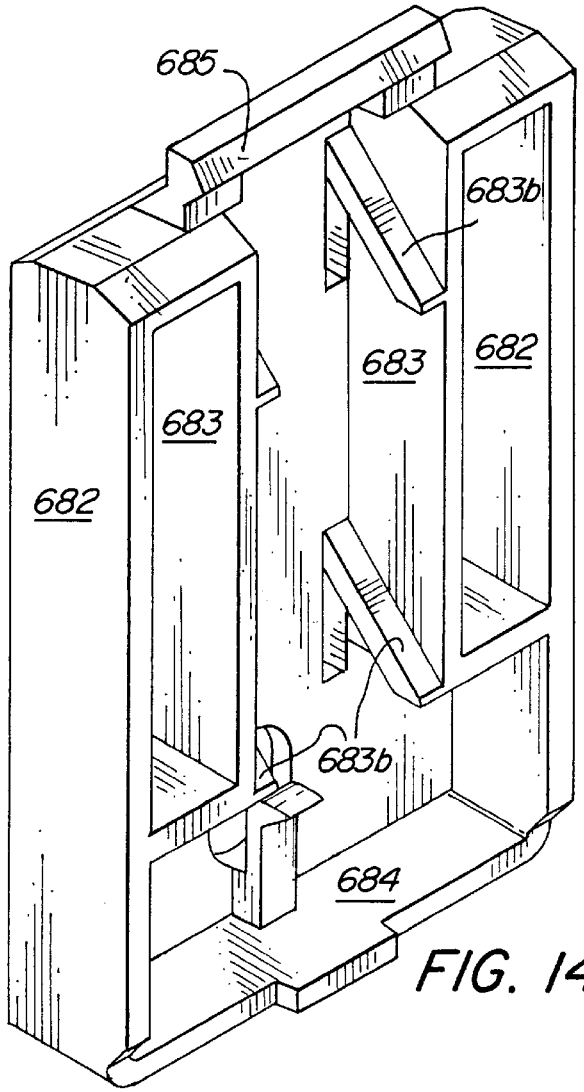
FIG. 14 is a perspective view of the outer guide member of the door guide shown in FIG. 13.

The outer guide member 605, as best seen in FIG. 14 has an open, generally rectangular configuration including a planar back wall 681, a pair of opposed side walls 682 and a bottom wall 684. Inwardly of the side walls 682 and parallel thereto is a pair of short internal walls 683. Formed on the inwardly facing surface of the internal walls 683 are two opposed pairs of raised, inclined liner guide ridges 683*b*.

A first lip 685 projects from the top of the outer guide member 605 and is adapted to slidably engage an inner surface B of the guide track A.

Figure 16:
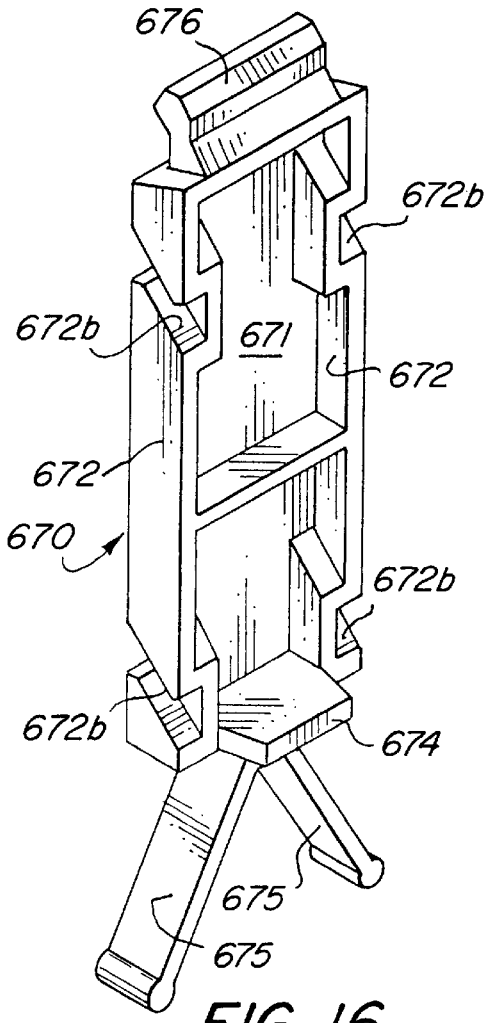
FIG. 16 is a perspective view of the inner guide member of the door guide shown in FIG. 13.

As best seen in FIG. 16, the inner guide member 607 has an open, generally rectangular body 670 including a planar back wall 671, a pair of opposed side walls 672 and a bottom wall 674. A pair of resilient wings 675 project downwardly from the bottom wall 674. Formed on the outer surfaces of the side walls 672 are two opposed pairs of inclined, linear recesses 672*b* which are configured to receive the raised guide ridges 683*b*, allowing the inner guide member 607 to slide toward or away from the outer guide member 605. The ridges 683*b* and the recesses 672*b* are inclined at an acute angle relative to the line of motion of the outer guide 605 in bracket 14.

A second lip 676 projects from the top of the inner guide member 607 and is adapted to slidably engage an inner surface C of the guide track A. The second lip 676 extends through an opening 685*a* in the base of the first lip 685 on the outer guide member 605. The first lip 685 and the second lip 676 project in opposite directions, perpendicularly to the plane of the body portion 624. It will be appreciated by the reader that, as the inner guide member 607 is moved outwardly of the bracket 14 by sliding along guide ridges 683*b*, the second lip 676 moves away from the first lip 685 to more securely engage the track A. The resilient wings 675 on the inner guide member 607 press against the bottom wall 684 of the outer guide member 605, biasing the inner guide member 607 outwardly of the bracket 14. The tongue 98 formed in the body portion 24 of the bracket 14 projects into an elongated recess 181*a* in the outer surface of the back wall 181 of the outer guide member 605 to prevent unintended separation of the outer guide member 605 from the bracket 14.

The procedure for assembling the bracket 14 to the panel 2 and frame elements 6 and 8 is essentially the same as described with respect to the preceding embodiment. After the door has been assembled, the inner guide member 607 mounted therein may be inserted into the channel of the bracket 14 until the detent 98 snaps into the recess 681*a* of the outer guide member 605.

Engagement of the door guide 601 with the track A is accomplished by simply pushing the guide against the track throat, resulting in the parting of the inner guide member 607 and the outer guide member 605 which reduces the spacing between the first lip 685 and the second lip 676 to enable entry of the lips through the track throat. Once the lips have passed through the track throat, the resilient wings 675 bias the inner guide member 607 toward the outer guide member 605 thereby increasing the spacing between the lips to engage the track A more securely.

To disengage the connector 601 from the track A, the bottom wall 674 of the inner guide member 607 is pressed toward the bottom wall 684 of the outer guide member 605 to reduce the spacing between the lips so that they may pass through the track throat.

Figure 20:
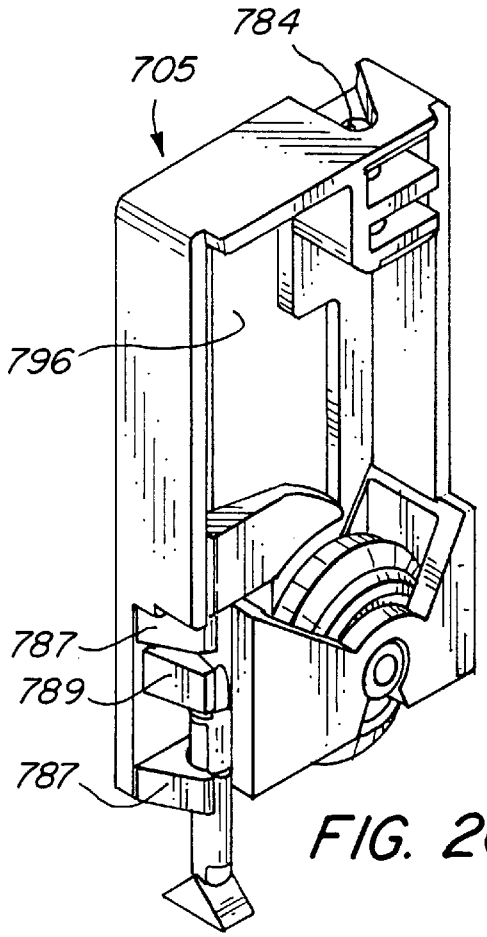
FIG. 20 is a perspective view of the roller assembly.
Figure 21:
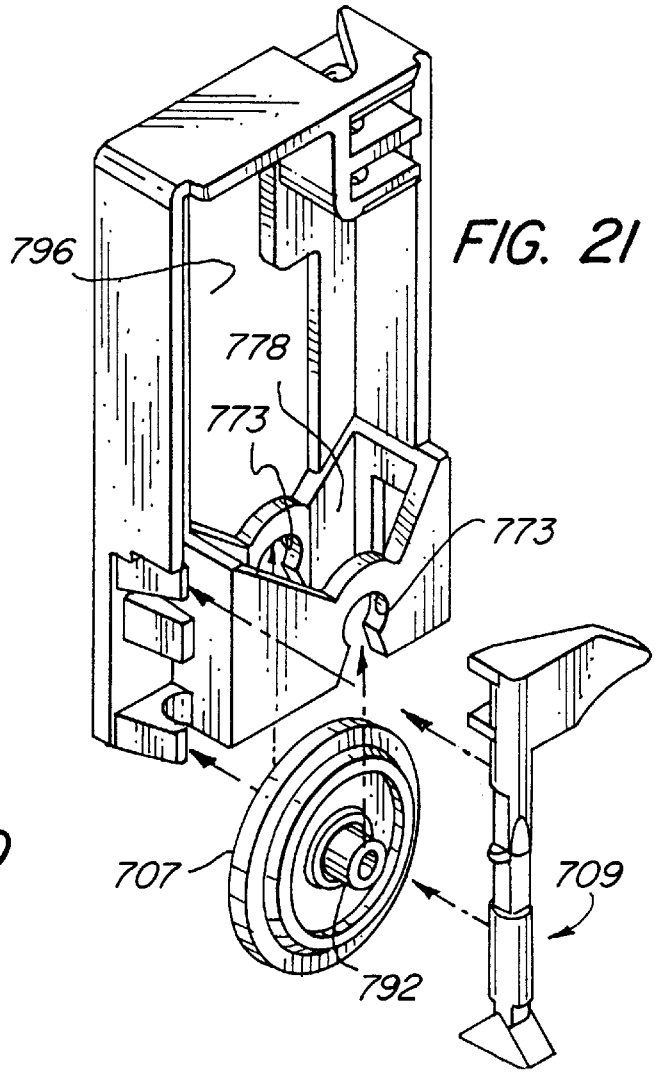
FIG. 21 is an exploded perspective view of the roller assembly shown in FIG. 20.

As best seen in FIGS. 20 and 21, the corner connector of this embodiment is generally designated by the numeral 701 and comprises the bracket 14, the roller mounting member 705 slidably seated in the bracket 14, a roller 707 rotatably mounted on the roller mounting member 705 and an anti-jump member 709 carried by the roller mounting member 705.

The bracket 14 is generally as described with respect to the first embodiment and has an inner surface 17 upon which the roller mounting member 705 is slidable.

The roller mounting member 705 is cooperatively dimensioned to slidingly seat in the channel of the bracket 14 and has a generally rectangular configuration with its upper end portion seated within the channel of the bracket 14 and its lower end portion extending below the bracket 14. The roller mounting member 705 has spaced side walls 776 and 778 which extend generally parallel to the plane of the body portion 24 of the bracket 14 and an end wall 782 at its upper end.

The end wall 782 of the roller mounting member 705 is provided with an aperture 784 which threadably seats a machine screw 86 having a head 88 which abuts against the lower surface of the end wall 30 of the bracket 14 to transfer the door load to it. The end wall 782 is provided with reinforcements 790 adjacent the aperture 784. The screw 86 enables adjustment of the position of the roller mounting member 705 and thereby the door height above the supporting surface and reduces play in the door by allowing the door to be moved upwardly snugly against the upper track (not shown). The end wall 30 of the bracket 14 has an access aperture 90 therein which permits a screwdriver blade to be inserted through the end wall 30 of the bracket 14 to engage the head 88 of the screw 86 in order to make such adjustments.

As best seen in FIGS. 20 and 21, the roller 707 is rotatably mounted adjacent the lower end of the mounting member 705 on an integral shaft 792 which extends through aligned apertures 773 in the side walls 776 and 778. As seen in FIG. 21, each of the apertures 773 includes an enlarged guide portion which allows the hub of the roller 707 to be snapped into place in the mounting member 705.

The roller mounting member 705 is limited in its movement outwardly of the bracket 14 by the detent or tab 98 which extends inwardly from the body portion 24 and seats in an elongated slot 796 in the sidewall 778 of the roller mounting member 705. The detent 98 is resiliently deflectable to be deflected into the plane of the bracket body portion 24 when the upper end of the roller mounting member 705 is inserted into the bracket 14 until it springs into the slot 796 upon continued movement of the mounting member 705 toward the upper end wall 30 of the bracket 14.

The anti-jump member 709 includes a handle 791 and an elongated shaft 793 extending therefrom and terminating in an enlarged track engagement member 795. The anti-jump member 709 is rotatably and translatably carried by clips 787 on the side of the roller mounting member 705, adjacent the rim of the roller 707, with the shaft 793 lying in the roller median plane. The anti-jump member 709 is first rotated, then displaced longitudinally, then rotated again to engage the track A. It will be appreciated that the corner connector 701 will move freely along the track A with the anti-jump member 709 in either the operative or retracted position.

The procedure for assembling the connector to the panel 2 and frame elements 6, 8 is essentially the same as described for the first embodiment. Thereafter, the roller mounting member 705 with the roller 707 mounted therein may be inserted into the channel of the bracket 14 until the detent 98 snaps into the slot 296 of the mounting member 705. Vertical adjustment can be made by adjusting the adjusting screw 86 as heretofore described.

Figure 22:
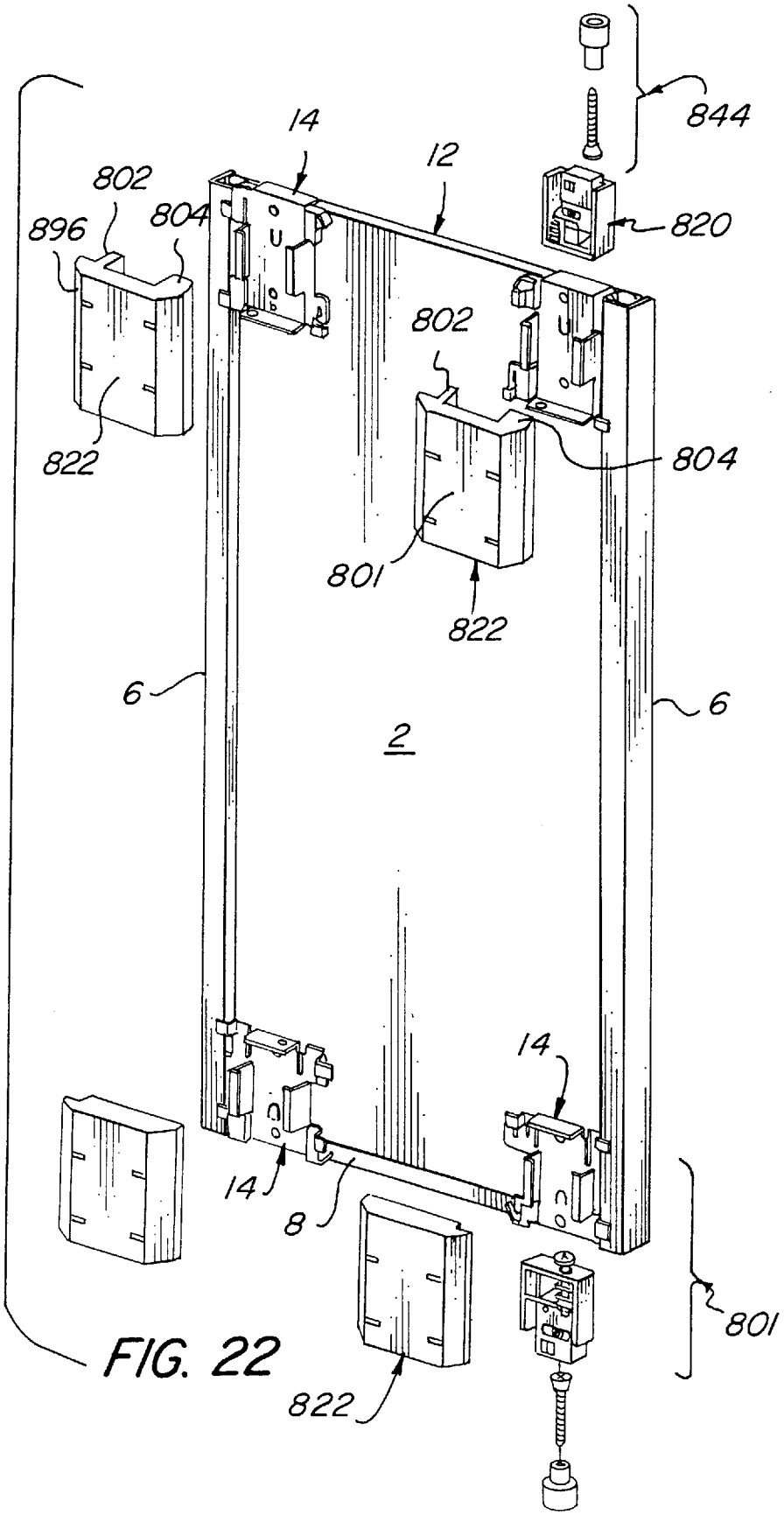
FIG. 22 is a partially exploded view of a door assembly with another embodiment of a connector of the present invention for use as a door swivel.

Turning lastly to the embodiment to FIG. 22 of the attached drawings, therein illustrated is a door assembly which is generally comprised of a pair of stiles 6, a pair of rails 8, and corner connectors generally designated by the numeral 801 which secure the rails and stiles in assembly. Seated in channels (not shown) formed in the rails 8 and stiles 6 is a door panel 2 which may be a mirror or other decorative panel such as a composite panel. The corner connector 801 includes a metal bracket generally designated by the numeral 14 and a pivot insert generally designated by the numeral 820 slidably seated within the metal bracket 14. Extending over the bracket 14 and pivot insert 820 is a cover or cap generally designated by the numeral 822.

The bracket 14 is as previously described.

Figure 23:
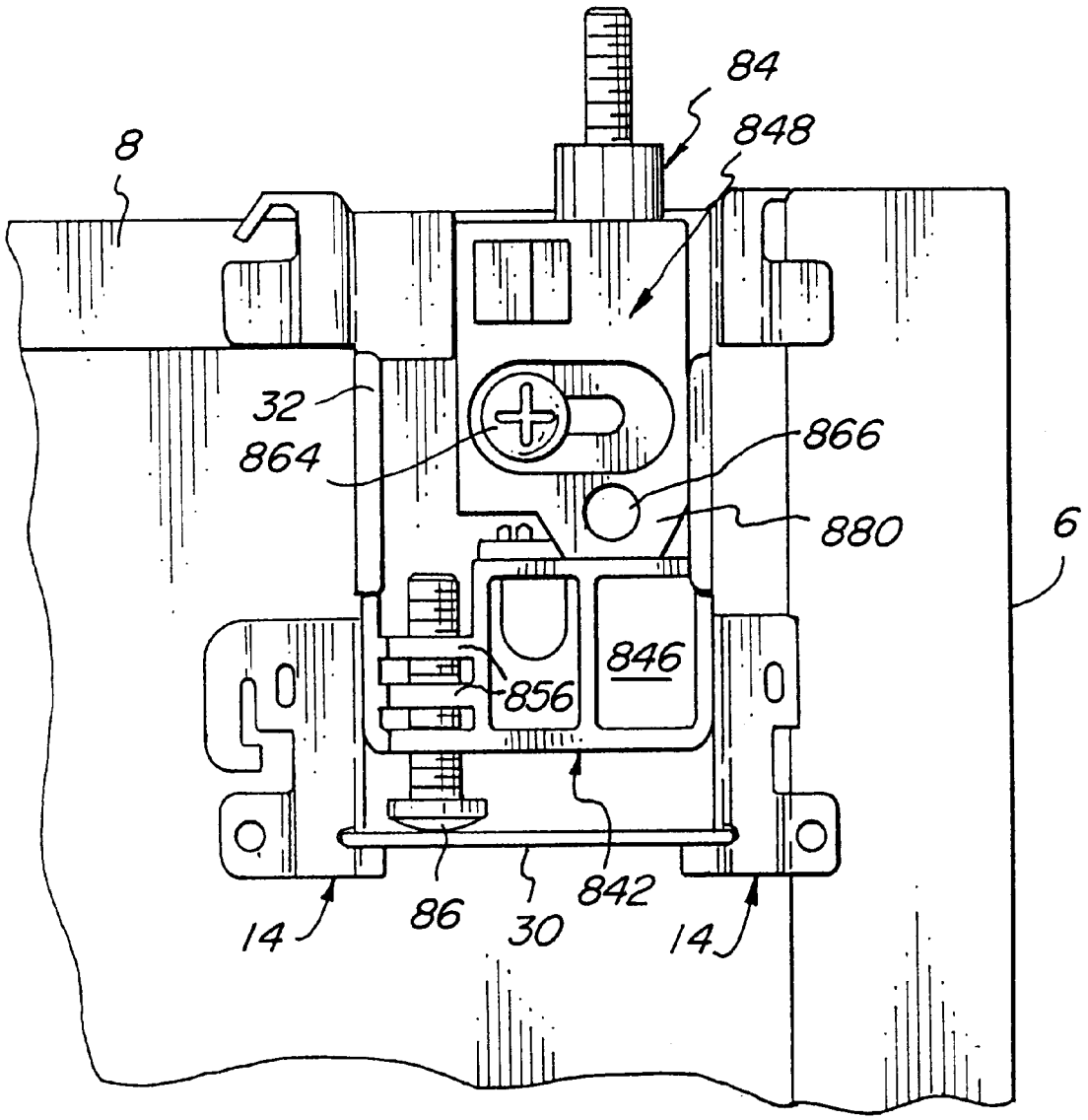
FIG. 23 is a fragmentary rear elevational view of the door assembly drawn to an enlarged scale and showing the upper connector.

As seen in FIG. 23, the pivot insert 820 is comprised of a pivot block generally designated by the numeral 842 and a pivot member generally designated by the numeral 844. The pivot block or body member 842 is, in turn, comprised of a base element generally designated by the numeral 846 and a movable element generally designated by the numeral 848 which are secured in assembly by the fastener 864.

Figure 24:
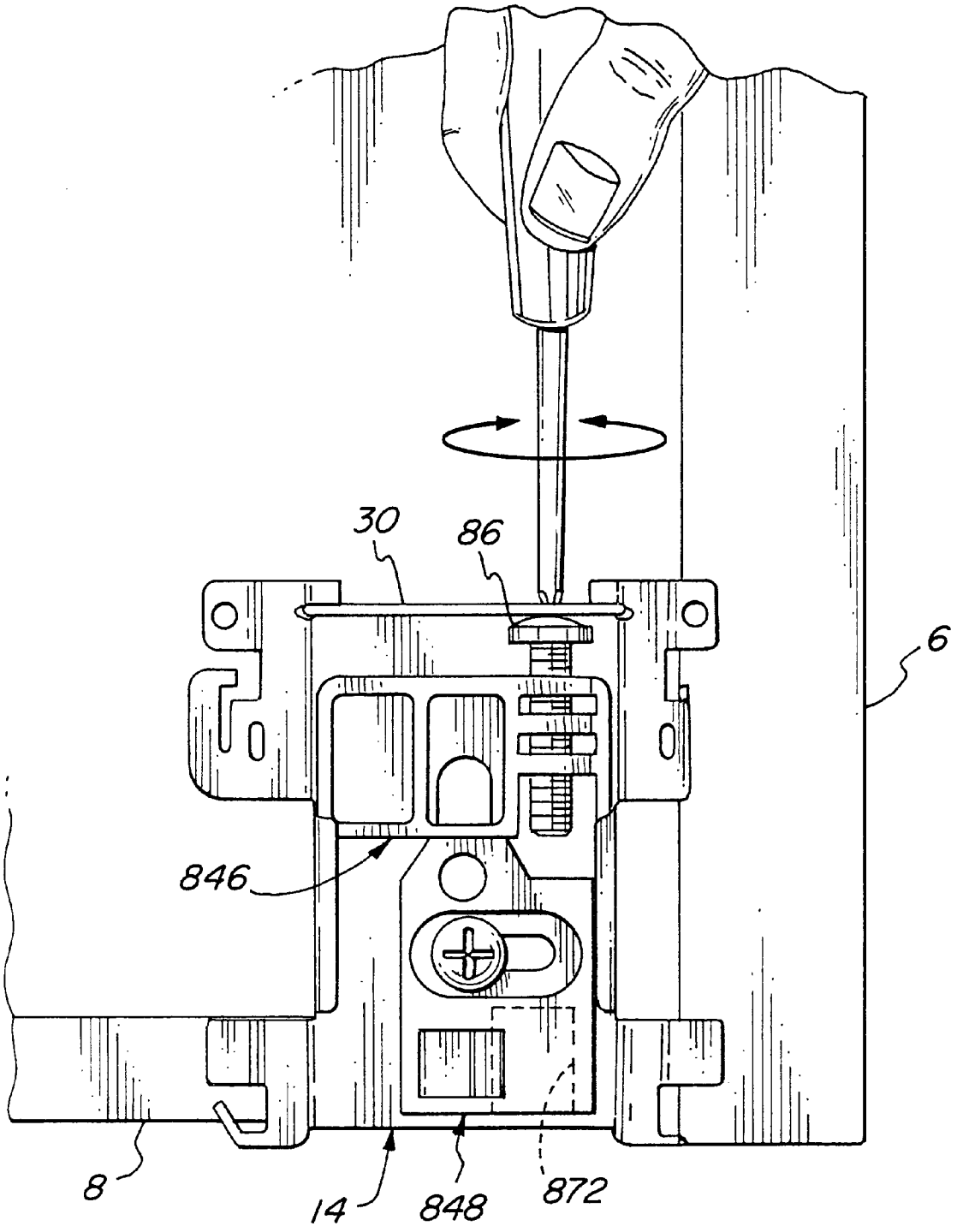
FIG. 24 is a fragmentary rear elevational view of a lower portion of the door drawn to an enlarged scale showing the bottom connector without the pivot member and showing a screwdriver engaged with the vertical adjustment screw.
Figure 25:
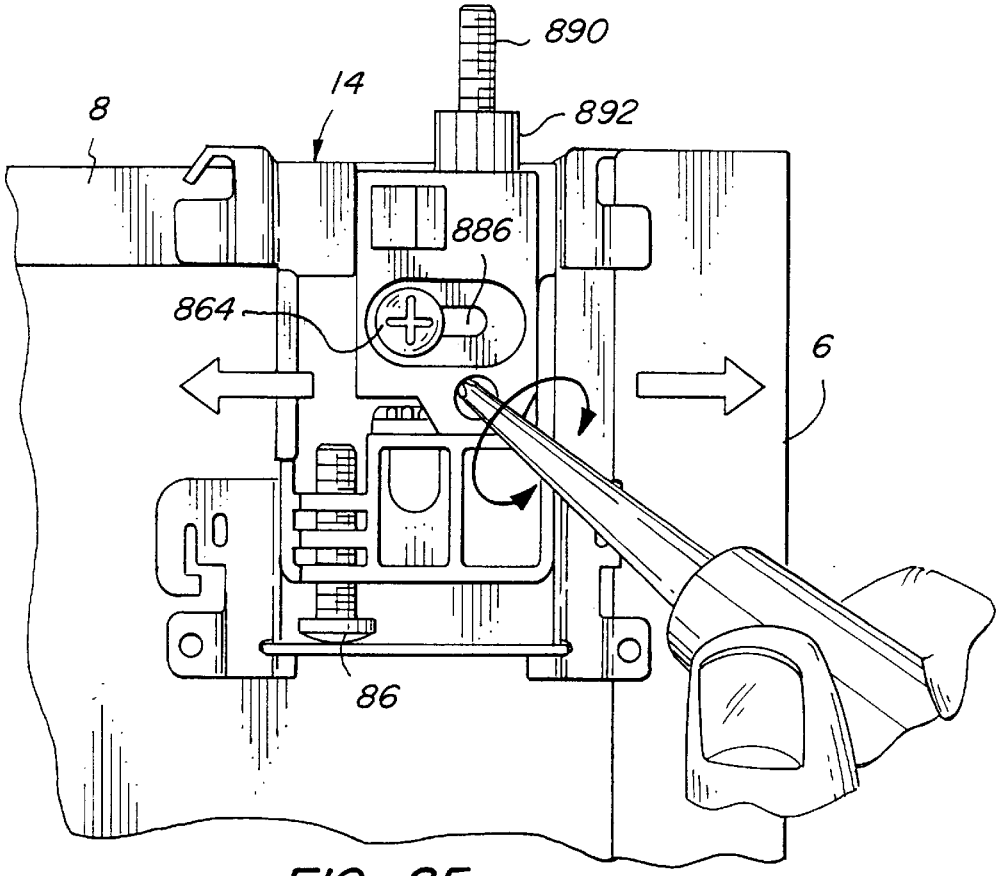
FIG. 25 is a fragmentary rear elevational view of a portion of the door showing the top connector with a tool engaged to effect horizontal adjustment.
Figure 26:
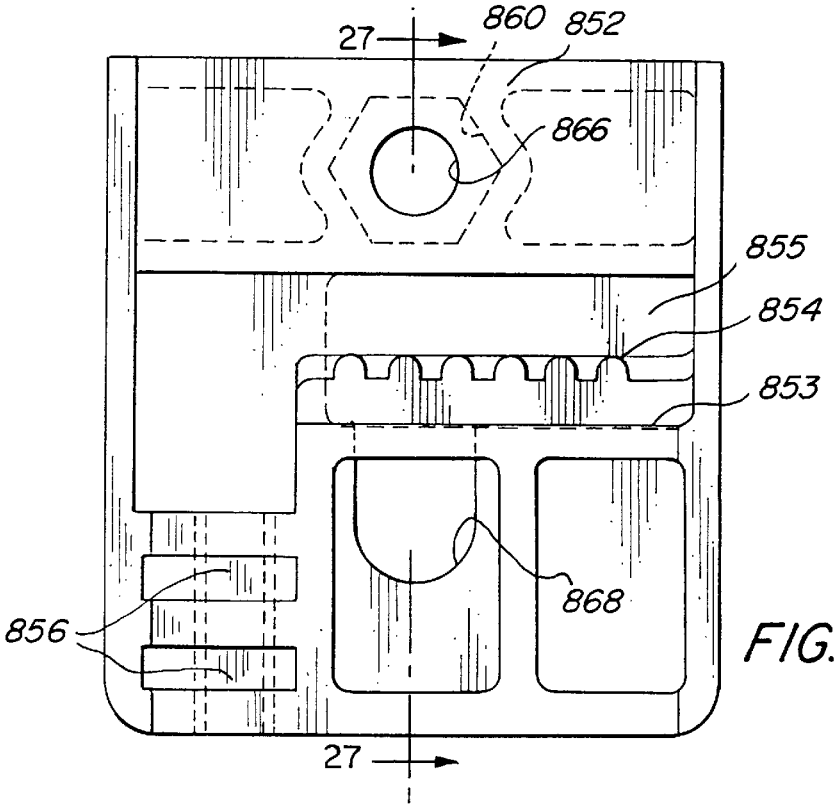
FIG. 26 is a front elevational view of the base element of the pivot block of the top connector drawn to an enlarged scale.
Figure 27:
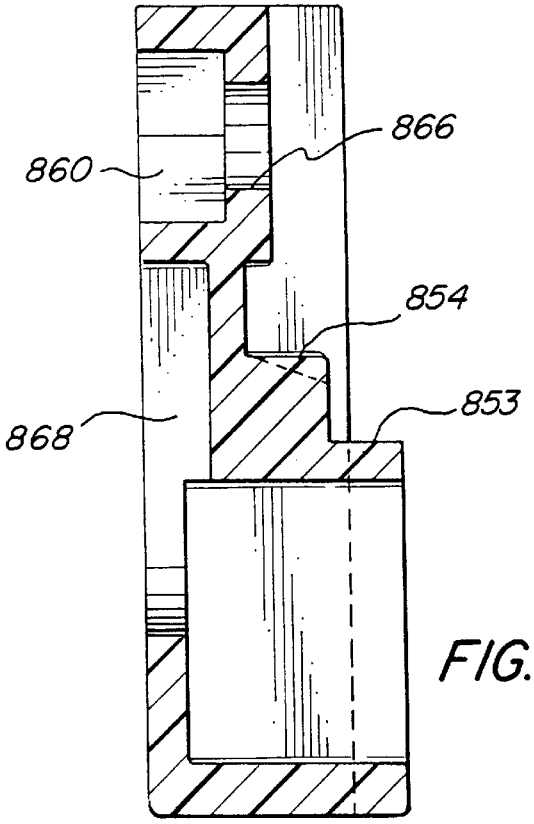
FIG. 27 is a sectional view thereof along the line 27—27 of FIG. 26.
Figure 28:
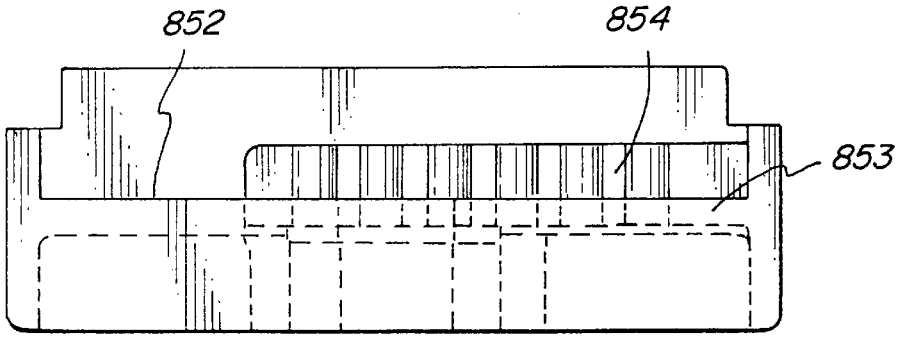
FIG. 28 is a top view thereof.
Figure 29:
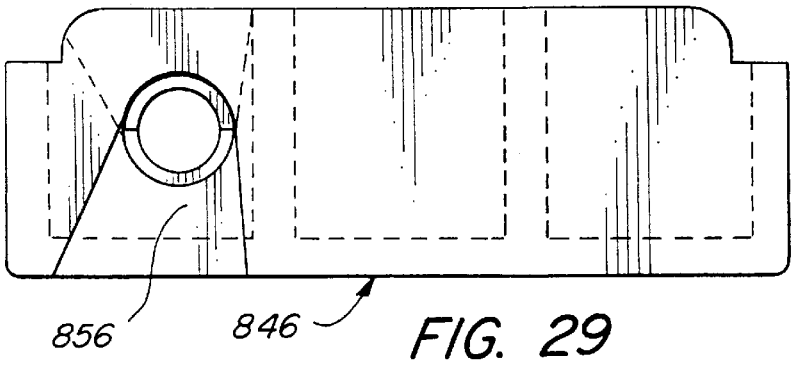
FIG. 29 is a bottom view thereof.
Figure 30:
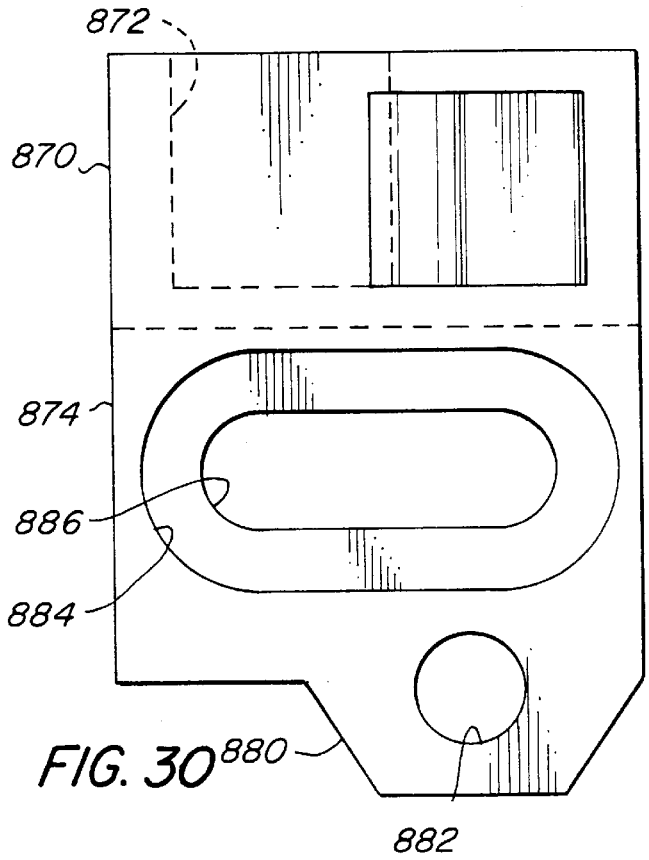
FIG. 30 is a front elevational view of the movable member drawn to an enlarged scale.

As seen in FIGS. 26–29, the base element 846 is molded with a recess 852 opening at the outer end thereof and in which is seated the movable element 848. Extending transversely along a portion of the inner end of the recess 852 is a toothed surface portion 854 above which is a planar shelf 853. A pair of horizontally extending ears 856 seat the vertical adjustment screw 858, and a hexagonal cavity 860 is molded in the opposite surface to seat a nut (not shown) which cooperates with a machine screw 864 extending through the aperture 866 to secure the movable element 848 thereto in a horizontally adjusted position as will be described more fully hereinafter. Also molded in the opposite surface is a channel 868 in which the tab 98 of the bracket 14 seats to maintain the pivot insert 820 in assembly therewith while allowing vertical adjustment. As seen in FIG. 24, the head of the vertical adjustment screw 86 bears upon the end wall 30 of the bracket 14 about the aperture 90. The vertical adjustment screw 86 is accessible to a screwdriver inserted through the aperture 90 as seen in FIG. 24.

Turning next to the movable element 848, it has an outer head portion 870 of greater thickness and in the outer end of which is provided a cylindrical recess 872 in which is seated the pivot member 844. Extending from the head portion 870 is a slide portion 874 of lesser thickness than the head portion 870 and it has a transversely extending lip 876 at its inner end which seats in the transverse channel 855 of the base element 846. An ear 880 on the slide portion 874 extends over the tooth surface portion 854 and bears against the shelf 853 above the toothed portion 854. A circular aperture 882 is provided in the slide portion 874 having its axis offset from the toothed surface portion 854 for a purpose to be described more fully hereinafter. Also provided in the slide portion 874 is a transversely extending slot 886. The head of the fastener 864 seats in the recess 884 and its shank extends through the slot 886 into the aperture 866 of the base element 846.

Figure 31:
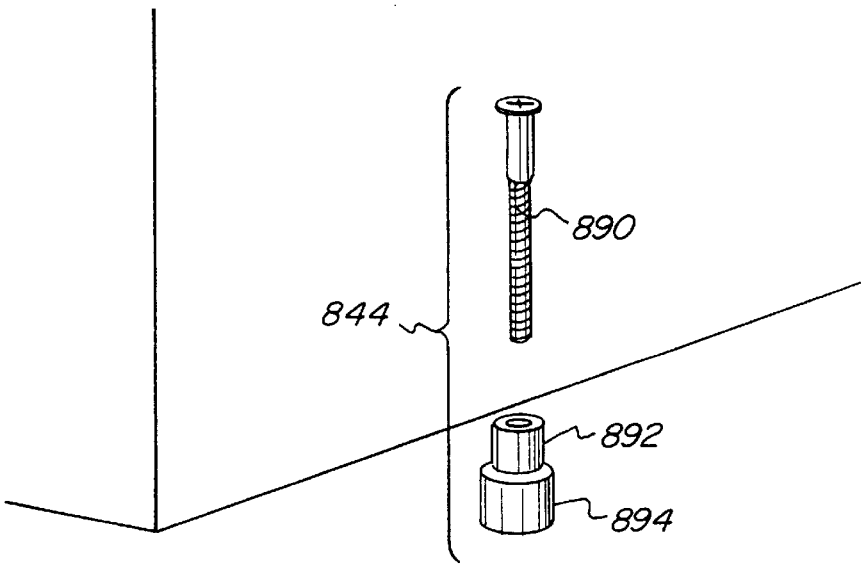
FIG. 31 is a perspective view of the disassembled bottom pivot member about to be installed in a typical installation.

As seen in FIG. 31, the pivot member 844 is comprised of the screw 890 and the bushing 892 which has a collar portion 894 of greater diameter. The head of the screw 890 bears against the bottom of the recess 872 and the collar portion 894 of the bushing 892 bears against the outer surface of the head portion 870 about the recess 872.

Figure 15:
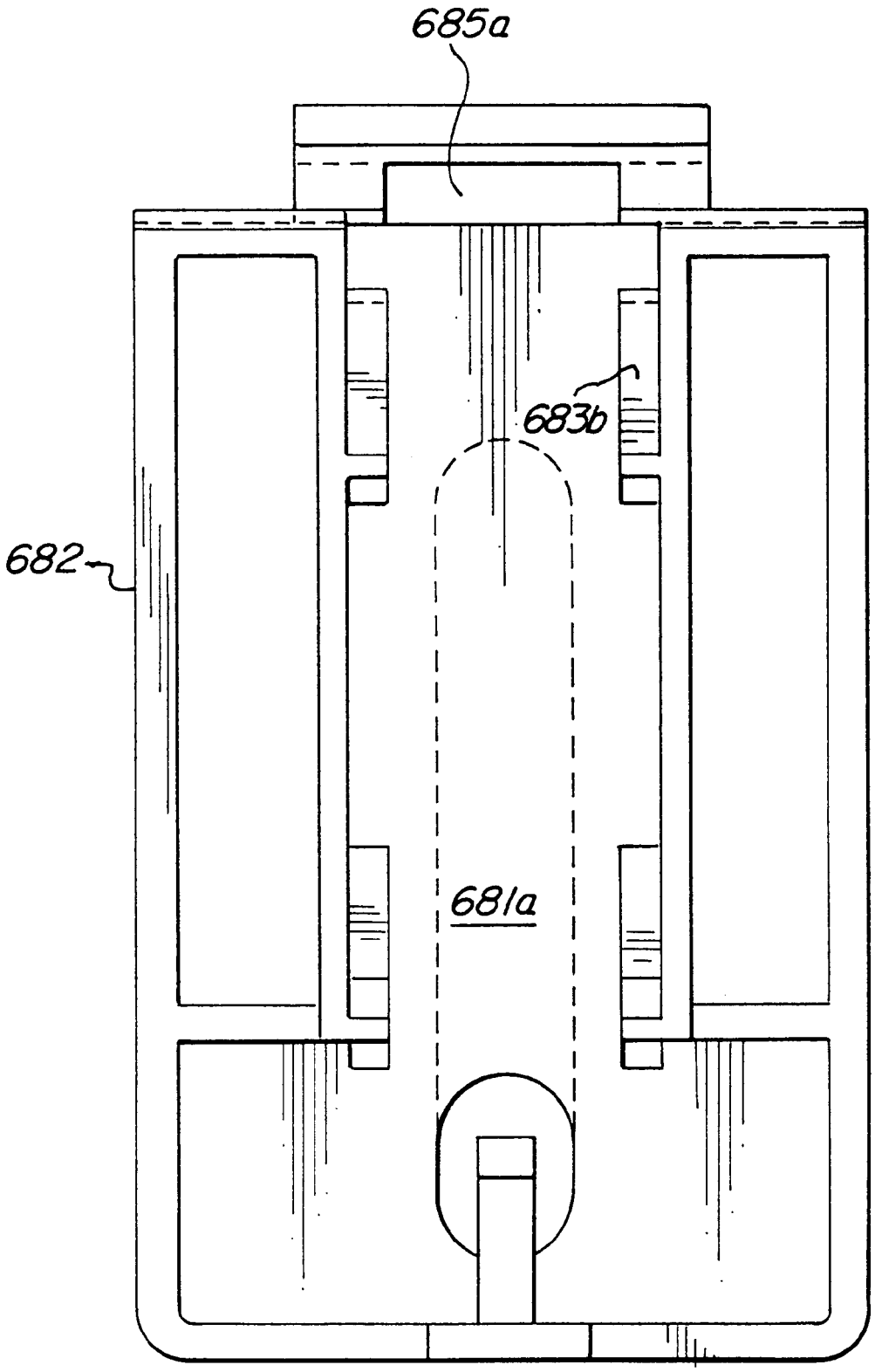
FIG. 15 is a front elevational view of the outer guide member of FIG. 14.
Figure 17:
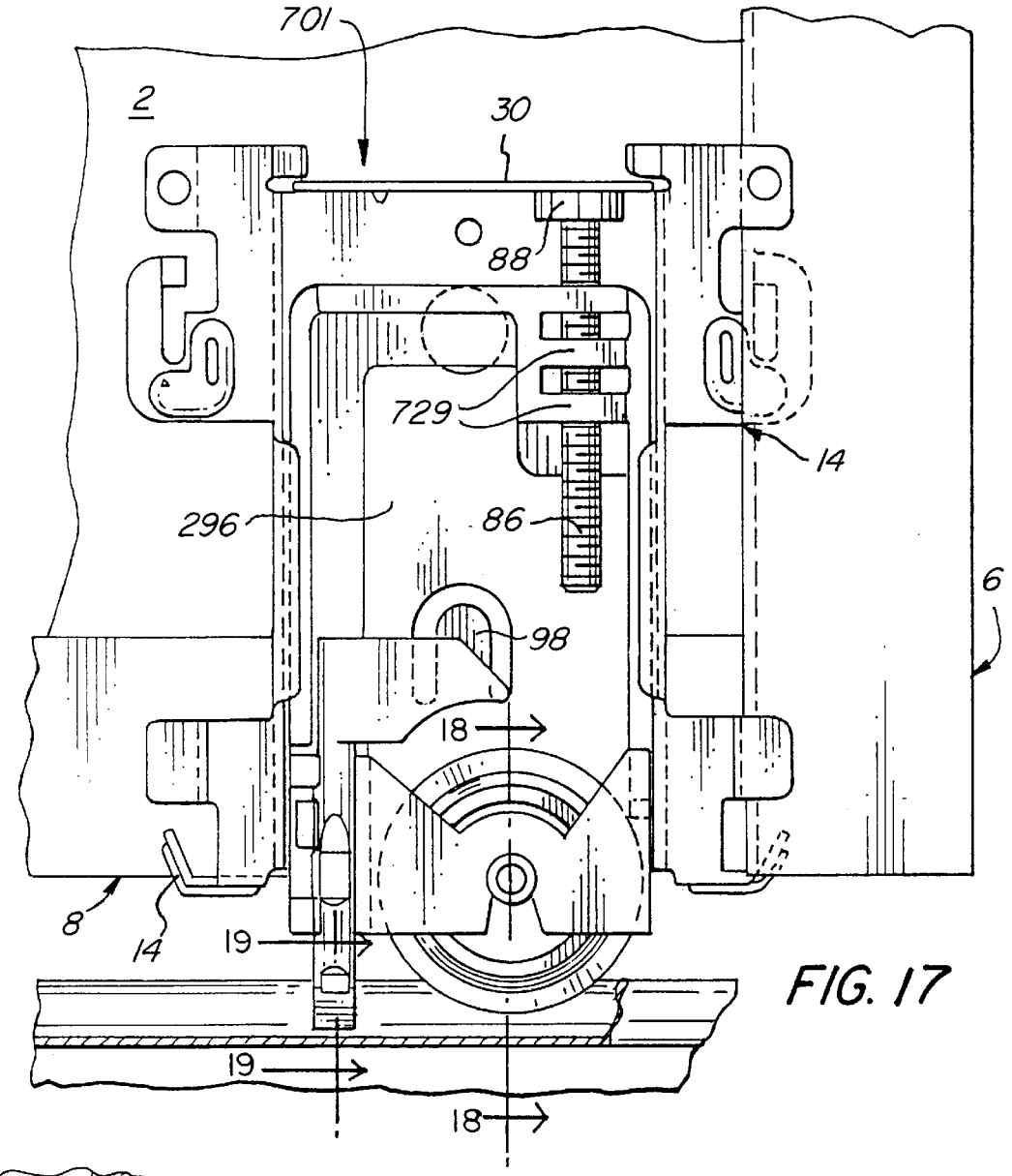
FIG. 17 is a front elevational view of a corner connector assembled to a door frame and utilizing another embodiment of roller assembly with an anti-jump element.
Figure 18:
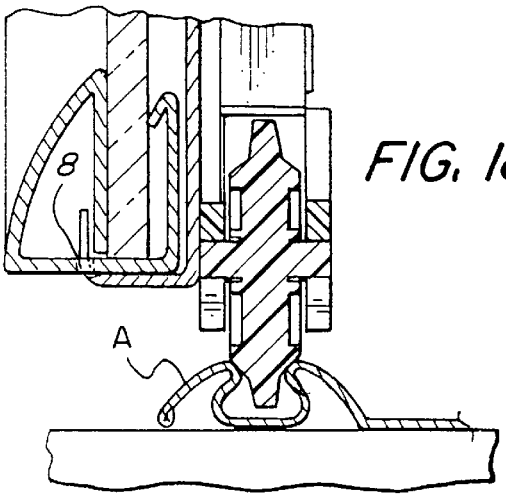
FIG. 18 is a sectional view along the line 18—18 of FIG. 17.
Figure 19:
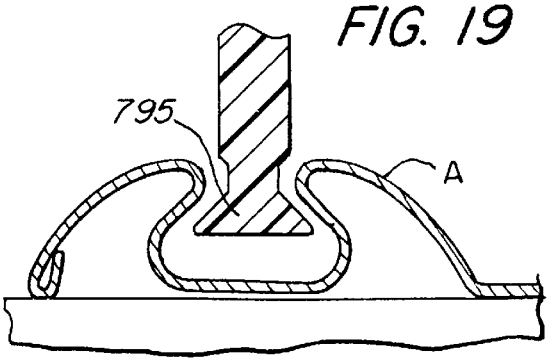
FIG. 19 is a sectional view along the line 19—19 of FIG. 17.

Turning lastly to the cover 822, as seen in FIGS. 15 through 17, it is molded with a central wall panel 895, a resiliently deflectable side flange 896 along one side, a side wall 898 along the other side, an end wall 900 at one end, and end wall segments 902, 904 at the other end. Four flexible fingers (not shown) extend perpendicularly to the inner surface of the wall panel 895 and resiliently snap on the bracket 14 to secure the cover in place. The pivot member 844 projects outwardly through the space between the end segments 802, 804. The covers 822 are provided in left handed and right handed sets so as to accommodate the different placement.

In assembling and mounting the door utilizing the corner connectors of this embodiment, the metal bracket 14 is utilized at each corner to secure the stiles 6 and rails 8 in assembly with the door panel 2. The door as so assembled may be conveniently packaged and shipped.

At the site, the installer determines whether the door is to swing to the right or the left. This may require the selection of pivot blocks 842, or movable elements 848, so as to have the recess 872 oriented adjacent the pivot side of the door.

Initially, the pivot members 844 are removed from the connector 801 assemblies and mounted into the header and the floor in precise vertical alignment by initially drilling holes and then placing the bushings 892 about the screws 890 by driving the screws 890 into the drilled holes.

The pivot inserts 820 are pushed into the open outer ends of the brackets 14 under the lips. As they are pushed inwardly, the tab 98 is deflected until the channel 868 in the base element 846 moves thereover, and the tab 98 springs thereinto to retain the block in assembly. The adjusting screw 86 in the upper assembly 818 is rotated by a screwdriver to move the base element 846 downwardly to the fullest extent possible. The adjusting screw 86 in the lower assembly 818 is rotated to move the base element 846 to a position about 10 mm from the end wall 30.

The door is then moved into the desired position and moved downwardly so that the bottom pivot member 844 seats in the recess 872 of the bottom movable element 848. The upper bracket assembly is moved to align the recess 872 with the pivot member 844 in the header and the adjusting screw 86 is rotated to seat the bushing 892 therein.

The adjusting screws 86 in both bracket assemblies 814 are then rotated to adjust the lower rail 8 of the door to a position about 9 mm from the floor and the collar 894 of the bushing 892 is adjacent the top rail 8.

The door can be moved to the right or the left by releasing the locking screws 864, and then inserting the screwdriver into the aperture 882 so that its flutes engaged the tooth surface portion 854. Rotation of the screwdriver will then "walk" the shank and thereby move the movable element 846 therealong. After the adjusted position has been reached, the locking screw 864 is then tightened.

As will be appreciated, in each of the several embodiments, the bracket and mounting assembly of the present invention allows use of common brackets to assemble the stiles, racks and panel for shipment in suitable packaging or on site. At the site, appropriate mounting members can be selected for a given installation and quickly snapped into place by deflection of the tab on the bracket. Vertical adjustment of the mounting member within the bracket and thereby the extent of projection therefrom is easily effected by a screwdriver inserted through the aperture in the end wall of the bracket.

Thus, it can be seen from the foregoing detailed description and attached drawings that the corner connector of the present invention is one which may be fabricated relatively inexpensively and easily connected to the door framing elements to provide a secure assembly. The roller mounting member may be preassembled in the connector or inserted after the door framing elements have been assembled.

Having thus described the invention, what is claimed is:

1. A corner connector for a door having frames and stiles seating a panel therewithin comprising:

(a) a bracket having:

(i) a generally planar body portion;

(ii) sidewalls extending perpendicularly to said body portion along opposite sides thereof, said sidewalls having inwardly extending lips along at least a portion of the length thereof, said lips extending parallel to and over said body portion to define a channel therebetween;

(iii) an end wall extending perpendicularly to said body portion at one end thereof and between said sidewalls; and (iv) an end flange at the other end of said body portion extending perpendicularly to said body portion in a direction oppositely of said sidewalls and end wall, said sidewalls and end flange having means thereon for engagement with the stiles and rails to secure them in assembly; and (b) a door mounting member slidably seated within said channel of said bracket and having a first surface slidably movable on said body portion of said bracket in a direction generally parallel to said sidewalls, said door mounting member having:

(i) a body portion;

(ii) an engaging portion extending outwardly of said channel for engagement with a door supporting surface;

(iii) a threaded fastener seated in said body portion and having a head bearing on said bracket end wall, said end wall having an aperture smaller than said head of said fastener providing access for a tool to engage said head of said fastener to adjust the spacing between said mounting member body portion and said bracket end wall and thereby the distance which said engaging portion extends from said bracket, said fastener transferring loads from said door mounting member to said bracket end wall, said body portion of said bracket and said mounting member having cooperating deflectable detent and recess thereon to permit sliding insertion of said mounting member into said channel of said bracket by deflection of said detent until seated in said recess and thereafter to limit movement of said mounting member outwardly of said channel.

2. A connector in accordance with claim 1 wherein said engaging portion is a roller rotatably mounted on said mounting member for rolling movement along a track providing the surface about the door opening.

3. A connector in accordance with claim 1 wherein the engaging portion is a slide guide for sliding movement along a track providing the surface about the door opening.

4. A connector in accordance with claim 1 wherein the engaging portion is a pivot element for engagement with the header or floor surface about the door opening.

5. A connector in accordance with claim 1 wherein said mounting member has a body element, an engaging element and means securing said body and engaging elements in assembly.

6. A connector in accordance with claim 1 wherein said detent is a resiliently deflectable element formed in said body portion of said bracket and said recess is provided by a slot in said body portion of said mounting member.

7. A connector in accordance with claim 1 wherein said bracket is metallic and said mounting member is fabricated of synthetic resin.

8. A movable door comprising:

(a) a pair of stiles having channels in the inner face thereof;

(b) top and bottom rails having channels in the inner face thereof;

(c) a door panel seated in said channels of said stiles and rails;

(d) connectors engaged with the ends of said stiles and rails to provide a rigid framework for the door, at least a pair of said connectors comprising:

(i) a bracket having (A) a generally planar body portion with sidewalls extending generally perpendicularly to said body portion along opposite sides thereof, said sidewalls having inwardly extending lips along an intermediate portion of the length thereof, said lips extending parallel to said body portion to define a channel therebetween;

(B) an end wall extending perpendicularly to said body portion at one end thereof between said sidewalls;

(C) an end flange at the other end of said body portion extending oppositely of said sidewalls and end wall, said end flange engaging the generally horizontally rail disposed thereon, said sidewalls also having outwardly extending side flanges adjacent the ends thereof with means thereon engaging the end portion of said stiles;

(e) a mounting member slidably seated within said channel of said bracket for sliding movement on said body portion of said bracket in a direction generally parallel to said sidewalls, said roller mounting member including means for transferring loads to said bracket end wall; and (f) an engaging member mounted on said mounting member and extending outwardly of said bracket for engagement with a surface about the door opening in which said door is disposed, said mounting member having a channel in its surface adjacent said body portion of said bracket and terminating inwardly of its ends, said body portion of said bracket having a deflectable detent extending into said channel, said detent being deflectable to permit insertion of said mounting member into said channel and thereafter limiting movement of said mounting member outwardly of said channel.

9. The movable door in accordance with claim 8 wherein said engaging member is a roller rotatably mounted on said mounting member for rolling movement along a track providing the surface about the door opening.

10. The movable door in accordance with claim 8 wherein said engaging member is a slide guide for sliding movement along a track providing the surface about the door opening.

11. The movable door in accordance with claim 8 wherein the engaging member is a pivot element for engagement with the header or floor surface about the door opening.

12. The movable door in accordance with claim 8 wherein said mounting member end wall includes an aperture and wherein said load transferring means is a threaded fastener threadably seated in said aperture in said end wall, said threaded fastener having a head abutting said end wall of said bracket.

13. The movable door in accordance with claim 8 wherein said bracket end wall has an aperture therein aligned substantially with said aperture in the mounting member end wall and of a diameter smaller than said head of said fastener and permits access for a tool to engage said head of said fastener to adjust the spacing between said mounting member end wall and said bracket end wall and thereby the distance which said roller projects from said bracket.

* * * * *